US011952782B2

(12) United States Patent
Thompson et al.

(10) Patent No.: US 11,952,782 B2
(45) Date of Patent: Apr. 9, 2024

(54) ANTI-BILLOW AWNING ASSEMBLY

(71) Applicant: CAREFREE/SCOTT FETZER COMPANY, Broomfield, CO (US)

(72) Inventors: Scott Patrick Thompson, Aspen, CO (US); Travis S. Titus, Superior, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 658 days.

(21) Appl. No.: 17/085,049

(22) Filed: Oct. 30, 2020

(65) Prior Publication Data

US 2021/0047835 A1 Feb. 18, 2021

Related U.S. Application Data

(62) Division of application No. 15/589,430, filed on May 8, 2017, now Pat. No. 10,844,605.

(60) Provisional application No. 62/332,814, filed on May 6, 2016.

(51) Int. Cl.
*E04F 10/06* (2006.01)

(52) U.S. Cl.
CPC ..... *E04F 10/0607* (2013.01); *E04F 10/0614* (2013.01); *E04F 10/0625* (2013.01); *E04F 10/0629* (2013.01); *E04F 10/0648* (2013.01); *E04F 10/0662* (2013.01)

(58) Field of Classification Search
CPC ..... E04F 10/0625; E04F 10/0603; E04F 10/0614; E04F 10/0618; E04F 10/0622; E04F 10/0648; E04F 10/0651; E04F 10/0662; E04F 10/0688
See application file for complete search history.

(56) References Cited

U.S. PATENT DOCUMENTS 1,325,105 A * 12/1919 Minnis ..... E06B 9/50 160/242
1,731,626 A * 10/1929 Hollingsworth .... E04F 10/0614 160/DIG. 4
3,074,761 A * 1/1963 Ryan ..... B60R 22/38 D8/358
3,882,921 A * 5/1975 Sandall ..... E06B 9/17076 160/242
4,371,127 A * 2/1983 Shimogawa ..... B60R 22/1855 280/808
4,436,137 A * 3/1984 Charles ..... E06B 9/92 160/242
4,524,791 A * 6/1985 Greer ..... E04F 10/0651 188/82.2
4,607,654 A * 8/1986 Duda ..... E04F 10/0614 242/385.4
4,673,144 A * 6/1987 Byford ..... B60R 22/38 242/382.6

(Continued)

*Primary Examiner* — Abe Massad

(57) ABSTRACT

An awning assembly and method is provided that includes an awning connection system coupling an awning canopy to a support structure. The awning connection system comprises a rolling assembly operably connected to the awning canopy, a lock bearing coupled to the rolling assembly, and an end cap, comprising a lock, coupled to the rolling assembly. Wherein, the rolling assembly comprises an unlocked mode, wherein the lock bearing is free from contact with the lock, and a locked mode, wherein the lock bearing is in contact with the lock.

20 Claims, 10 Drawing Sheets

(56) References Cited

U.S. PATENT DOCUMENTS

| | | | | | |
|---|---|---|---|---|---|
| 4,705,148 | A * | 11/1987 | Zindler | E04F 10/0648 | 160/67 |
| 5,732,756 | A * | 3/1998 | Malott | E04F 10/0625 | 160/67 |
| 5,819,831 | A * | 10/1998 | Schanz | E06B 9/174 | 242/399 |
| 5,860,463 | A * | 1/1999 | Lassen | E06B 9/70 | 160/84.02 |
| 6,089,306 | A | 7/2000 | Frey, Jr. | | |
| 6,971,433 | B2 | 12/2005 | Wagner et al. | | |
| 7,017,976 | B1 | 3/2006 | Rutherford et al. | | |
| 7,121,314 | B2 * | 10/2006 | Hicks | E04F 10/0651 | 160/67 |
| 8,220,520 | B2 * | 7/2012 | Lukos | G03B 21/58 | 160/242 |
| 8,272,425 | B2 * | 9/2012 | Coenraets | E06B 9/58 | 160/133 |
| 2010/0126544 | A1 | 5/2010 | Wagner | | |

* cited by examiner

ANTI-BILLOW AWNING ASSEMBLY

CROSS-REFERENCE TO RELATED APPLICATIONS

The present application is a divisional application claiming priority under 35 U.S.C. § 121 to co-pending U.S. nonprovisonal application Ser. No. 15/589,430 that was filed on May 8, 2017 and published on Nov. 9, 2017 under publication number US 2017-0321427 entitled ANTI-BILLOW AWNING ASSEMBLY, which was a non-provisional application filed under 35 U.S.C. § 111 claiming priority under 35 U.S.C. § 119(e) to U.S. Provisional Patent Application Ser. No. 62/332,814 filed May 6, 2016 entitled ANTI-BILLOW AWNING ASSEMBLE The above-identified applications are incorporated herein by reference in their entireties for all purposes.

FIELD OF THIS DISCLOSURE

The present disclosure relates to an anti-billow awning assembly and connection system, and more particularly, an assembly that secures an awning canopy cover to a structure in a retracted position that includes enhanced safety features over conventional awning systems.

BACKGROUND

An awning is a welcome addition to a house, recreational vehicle, or other dwelling. The awning typically provides increased enjoyment of an outdoor area surrounding the dwelling. The awning can cast a shaded area that creates an escape from direct sunlight, thereby providing a space in which an occupant of the dwelling may relax. The shaded area created by the awning contributes to the relaxation of the occupant in that there is a perceived decrease in temperature and, thus, generally becomes more comfortable. The awning as well advantageously protects occupants underneath from precipitation.

Known awning structures generally consist of a base that is permanently affixed to the dwelling, and a canopy that is removably attached to the base. Conventional awning structures are discussed in detail further in U.S. Pat. No. 6,971,433 assigned to Carefree/Scott Fetzer Company. U.S. Pat. No. 6,971,433 is incorporated herein by reference in its entirety for all purposes.

While awnings used on a home or recreational vehicle are opened and closed using a manual crank on a motor/switch, the slide-out canopy operates differently. The slide-out canopy is opened and retracted as the slide-out opens outward. Further details of the slide-out canopy operation are discussed in U.S. Pat. No. 7,017,976 assigned to Carefree/Scott Fetzer Company. U.S. Pat. No. 7,017,976 is incorporated herein by reference in its entirety for all purposes.

Illustrated in FIG. 1 is conventional awning system 1 known in the prior art. The conventional awning system 1 includes a strike plate 2 attached to a supporting structure 4 (e.g., a recreational vehicle). The strike plate 2 is attached to or contacts an interfacing lock 6. The interfacing lock 6 is attached to a rolling assembly 7 to lock (e.g., prevent from unrolling) the rolling assembly into a static configuration. To correctly lock the rolling assembly 7, an adjust bolt 10 is utilized to alter a length of the interfacing lock 6 to facilitate locking of the rolling assembly 7. Correctly altering the length of the interfacing lock 6 is dependent on the installer. The conventional awning system 1, because of the need for the strike plate 6, adds additional structures mounted on the supporting structure 4 (e.g., strike plates and fasteners).

SUMMARY

One aspect of the present disclosure includes an awning assembly that includes an awning connection system coupling an awning canopy to a support structure. The awning connection system comprises a rolling assembly operably connected to the awning canopy, a lock bearing coupled to the rolling assembly, and an end cap, comprising a lock, coupled to the rolling assembly. Wherein, the rolling assembly comprises an unlocked mode, such that the lock bearing is free from contact with the lock, and a locked mode, characterized in that the lock bearing is in contact with the lock.

Another aspect of the present disclosure includes a method of providing an awning canopy assembly. The method comprises providing an awning connection system that couples an awning canopy to a support structure during use. The awning connection system comprising providing a rolling assembly operably connectable to the awning canopy, providing a lock bearing coupled to the rolling assembly and providing an end cap comprising at least one lock. The end cap coupled to the rolling assembly, wherein, the rolling assembly comprises an unlocked mode, wherein the lock bearing is free from contact with the lock, and a locked mode, wherein the lock bearing is in contact with the lock.

Yet another aspect of the present disclosure includes an awning canopy assembly comprising an awning connection system coupling an awning canopy supported by a roll bar to a support structure during use. The awning connection system comprising a rolling assembly operably attached to a hub of the roll bar via a rotatable connection and the rotatable connection is coupled to and between two wheels, wherein the rotatable connection and the two wheels are co-axially connected to the awning canopy. The awning connection system further comprising a lock bearing comprising at least one tooth comprising a leading surface, the lock bearing coupled to the rolling assembly. The awning connection system additionally comprising an end cap comprising at least one lock having a stopping surface that interacts with the leading surface when in a locked mode, the end cap is coupled to the rolling assembly, wherein, the rolling assembly comprises the locked mode, and an unlocked mode wherein the leading surface is free from contact with the stopping surface.

While yet another aspect of the present disclosure comprises anti-billow awning assembly comprising a rolling assembly movable between a first position and a second position by a track wheel assembly. The awning assembly further comprises a lock bearing coupled to the track assembly and an awning canopy, the lock bearing having a plurality of locking teeth. The track wheel assembly includes first and second wheels for movement of the rolling assembly and lock bearing between the first position and the second position, the lock bearing freely rotatable while in the first position. At least one locking member engages the lock bearing when the lock bearing and track wheel assembly are in the second position, the locking teeth and the at least one locking member preventing rotation of the locking member in at least one direction to prevent unspooling of the awning canopy.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
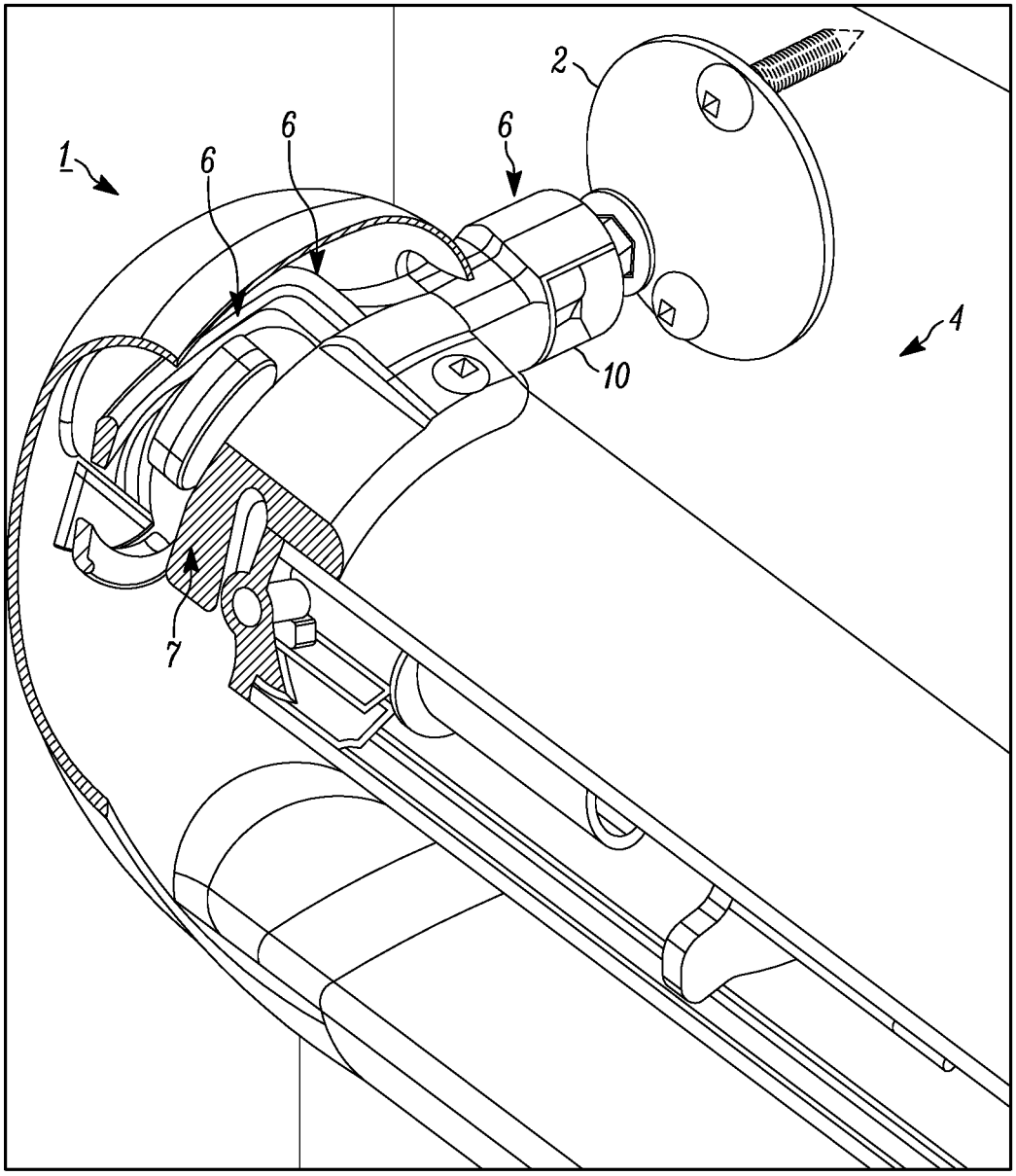
PRIOR ART FIG. 1
FIG. 1 is a perspective view of conventional awning assembly of an awning system as known in the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to an anti-billow awning assembly and connection system, and more particularly, an assembly that secures an awning canopy cover to a structure in a retracted position that includes enhanced safety features over conventional awning systems.

Now referring to FIGS. 2-5, a anti-billowing awning canopy assembly 20 is illustrated. The anti-billowing awning assembly 20 includes an awning connection system 18. The awning assembly 20 comprises an awning canopy 26 that is mounted to a support structure 24, which might be, for example, a side wall of a recreational vehicle, a mobile home, a recreational vehicle slide-out, or a more permanent building structure.

Figure 2:
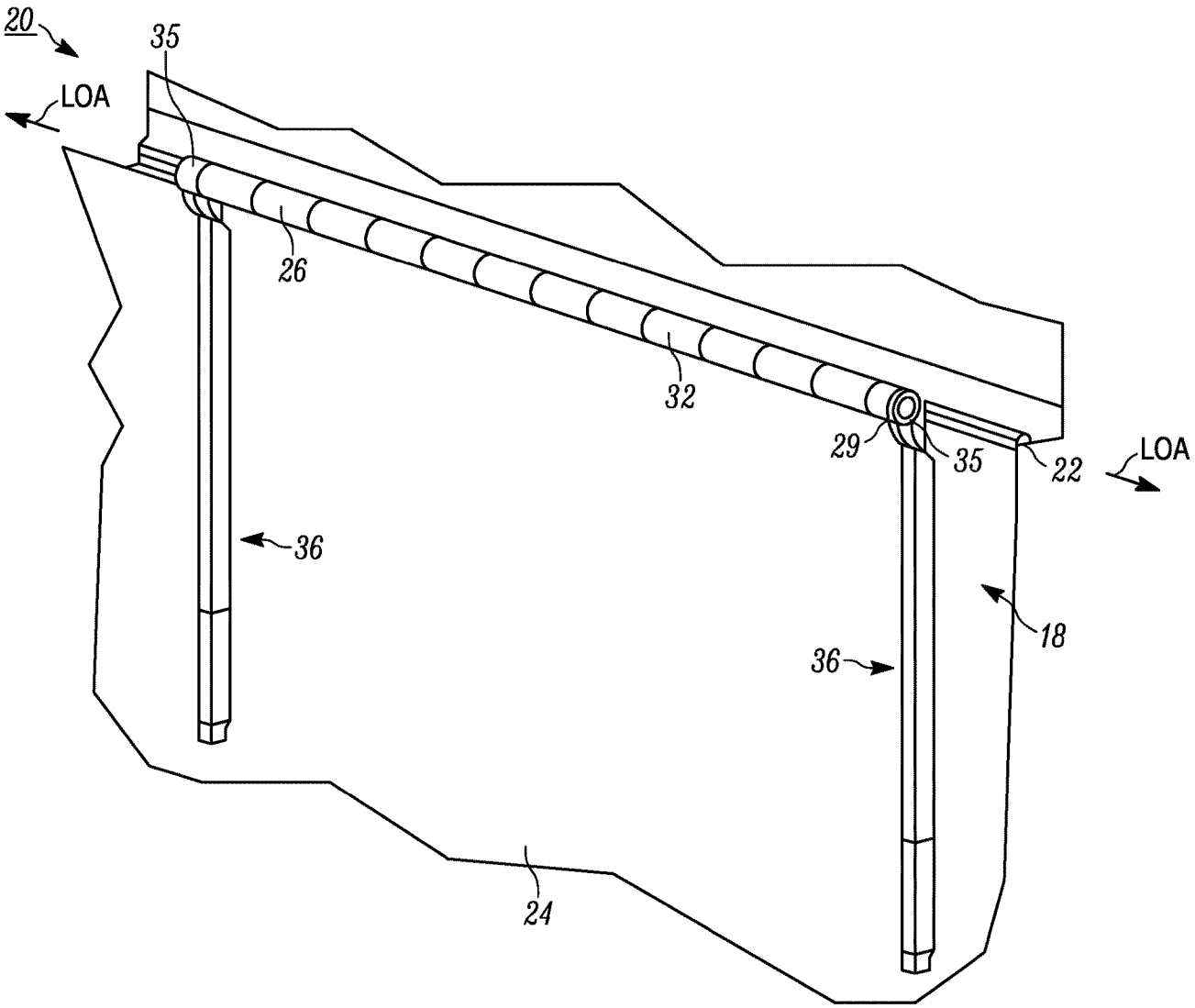
FIG. 2 is a perspective view of an anti-billowing awning canopy assembly in a retracted position in accordance with one example embodiment of the present disclosure.
Figure 6:
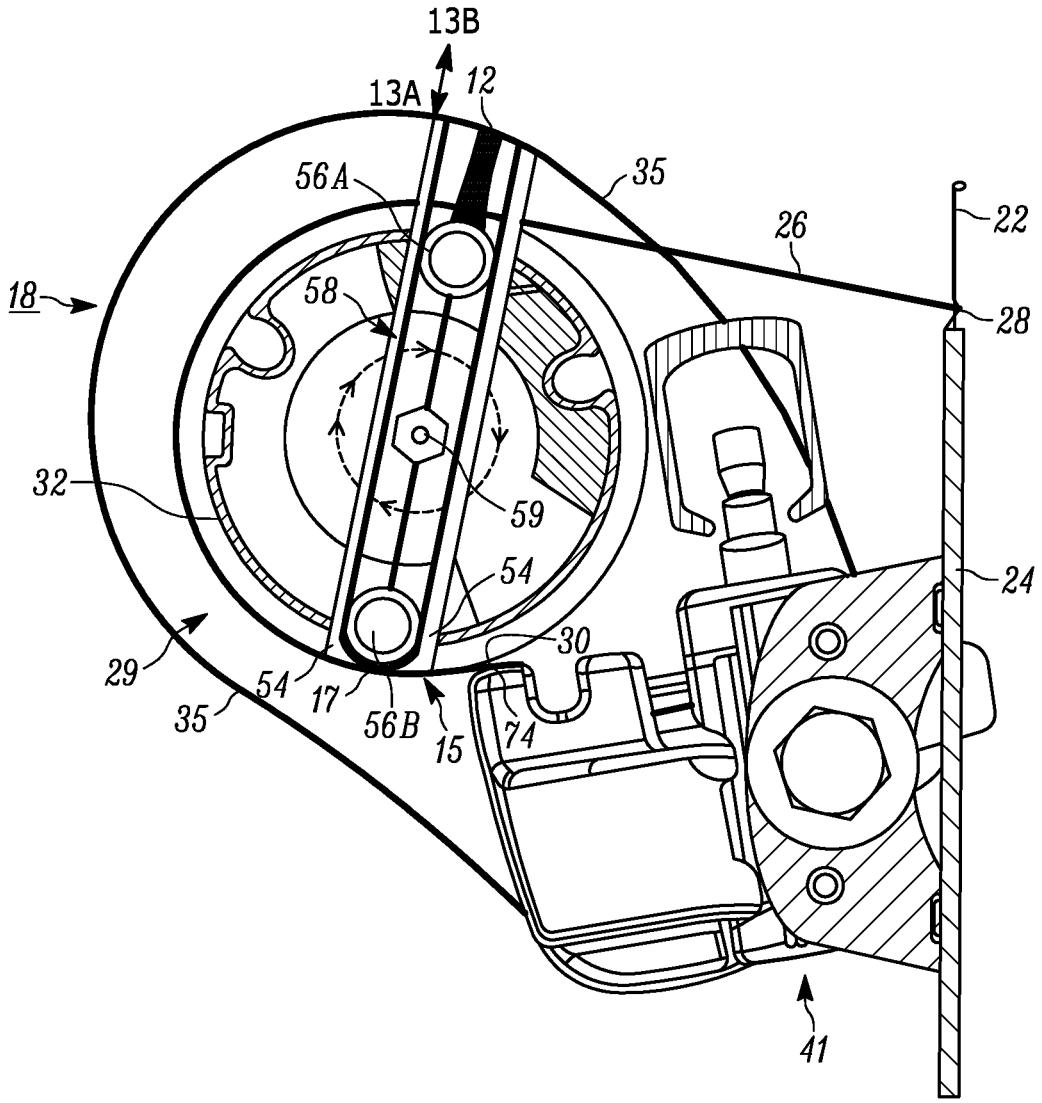
FIG. 6 is side elevation section view of a rolling assembly taken along section lines 6-6 of FIG. 5.
Figure 7:
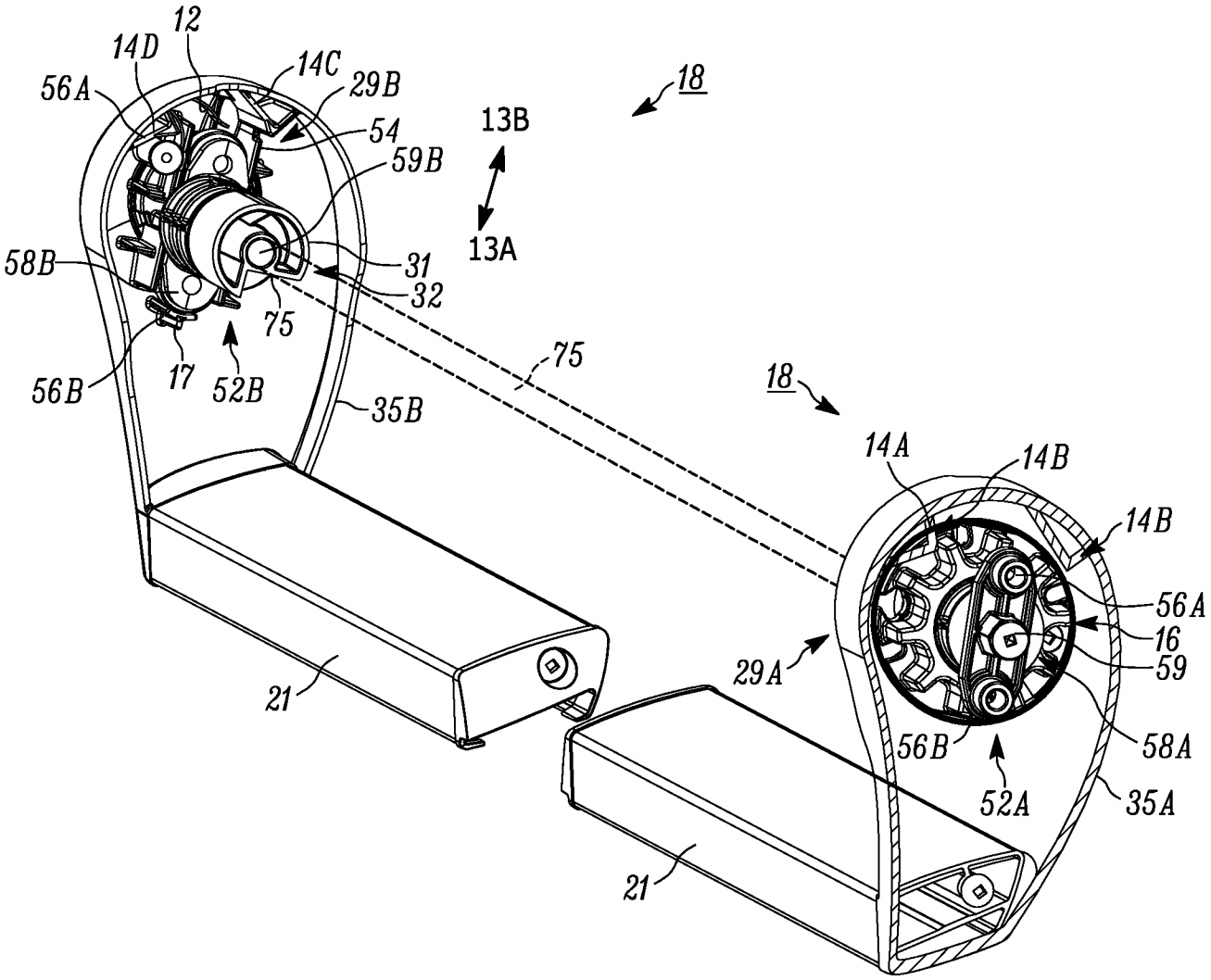
FIG. 7 is a partial-prospective view of a anti-billowing awning assembly constructed in accordance with another example embodiment of the present disclosure.

The awning canopy 26 comprises an inner or proximal edge 28 secured to a support rail 22 and an outer edge 30 secured to a support point 74 of an axle 75, illustrated in FIGS. 6 and 7, located within a roll bar 32. In the illustrated example embodiment, the roll bar 32 is disposed parallel to the support structure 24 in a longitudinal direction along a longitudinal axis (LOA), as illustrated in FIG. 2. The awning connection system 18 comprises a rolling assembly 29, end caps 35, and a lock bearing or sprocket 52, illustrated in FIG. 7. The roll bar 32 is operably connected to the rolling assembly 29 via a hub 31 of the rolling assembly. In one example embodiment, the roll bar 32 is driven by one or more motors, transmission assemblies, and/or support springs 42 (see FIG. 4) that are operatively connected to, and maintained by, a support system 36 in the form of a pair of scissor-type arms or extension arms 38. The roll bar 32 may be supported by a single arm, a pair of arms, or some other support configuration. In another example embodiment, the scissor arms 38 may not have a motor or transmission assembly, but instead an idler hub (not shown) that allows for unimpeded rotation of the axle 75 coupled to outer edge 30 of the awning canopy 26. The rolling assembly 29 is enclosed in respective end caps 35. The end caps 35 are made from plastic or metal.

Figure 3:
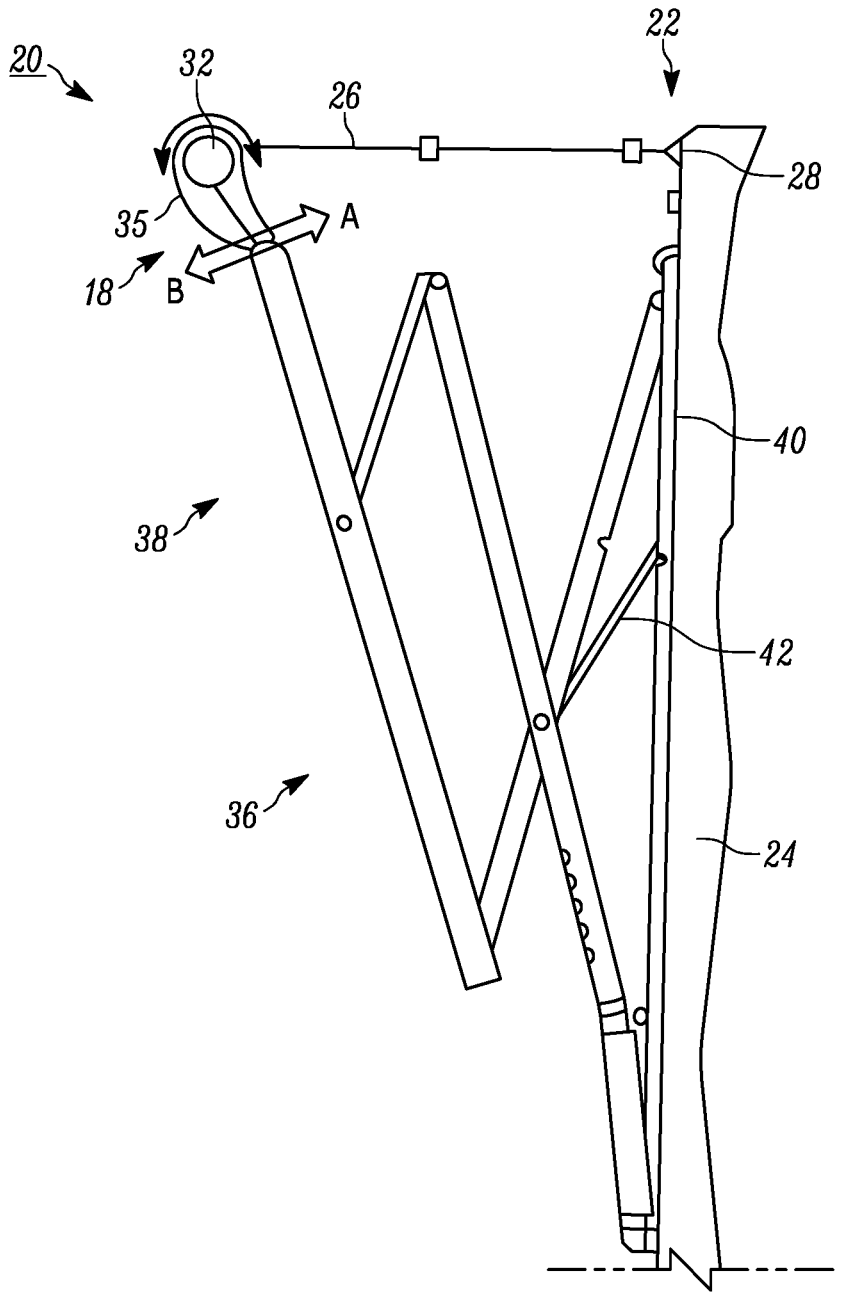
FIG. 3 is a side elevation view of a anti-billowing awning canopy assembly in a partially expanded or partially open position in accordance with one example embodiment of the present disclosure.
Figure 4:
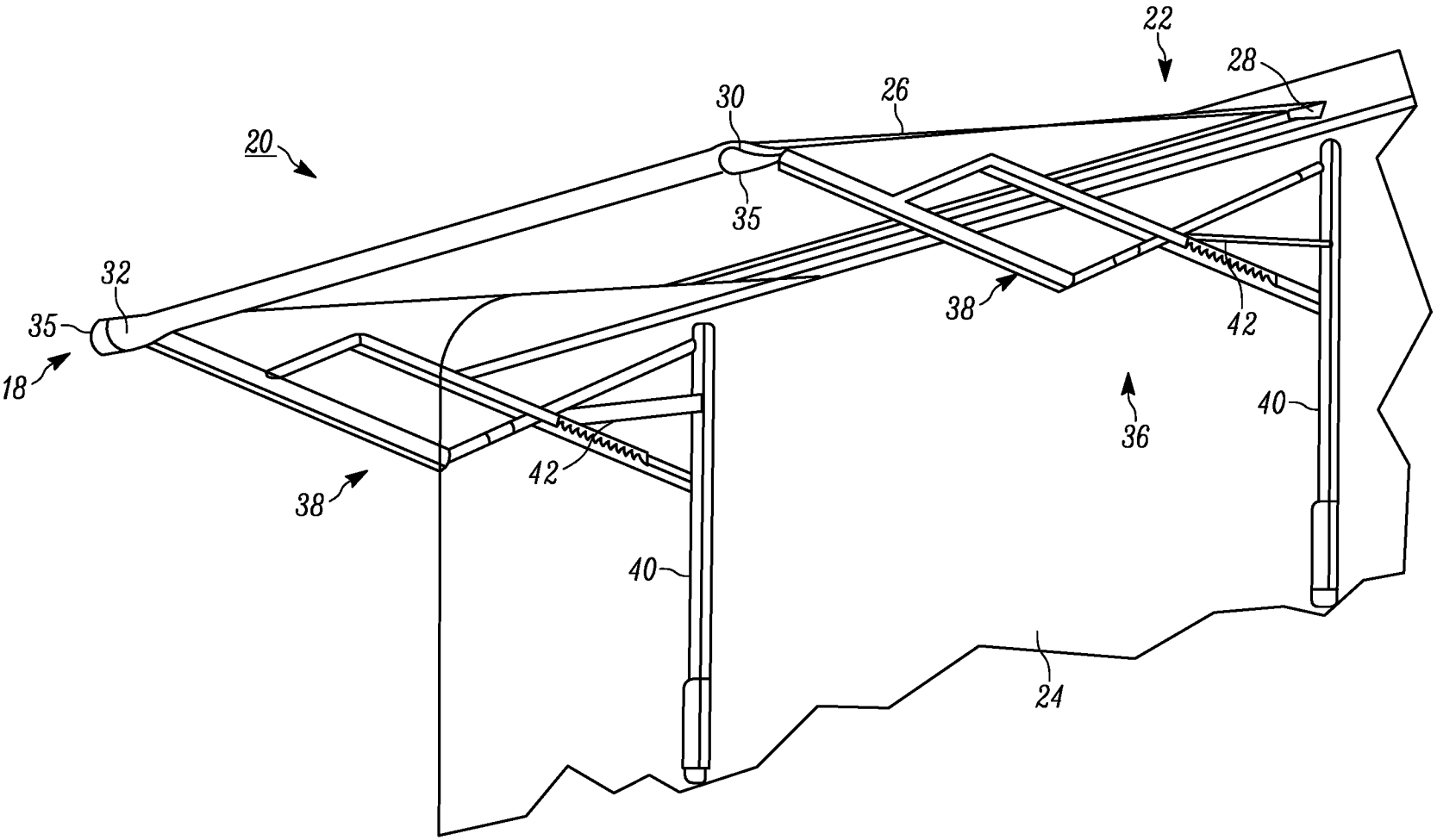
FIG. 4 is a perspective view of a anti-billowing awning canopy assembly in an open or expanded position in accordance with one example embodiment of the present disclosure.

In one example embodiment, the support system 36 may comprise one of two scissors-type arms 38 (that support the awning assembly 20 as shown in FIG. 3) mounted on a vertical track 40 that during use would attach to the support structure 24. The support system 36 is shown extended in FIG. 4 with the awning assembly 20 and awning canopy 26 unwound from the roll bar 32 and retracted in FIG. 2.

Figure 5:
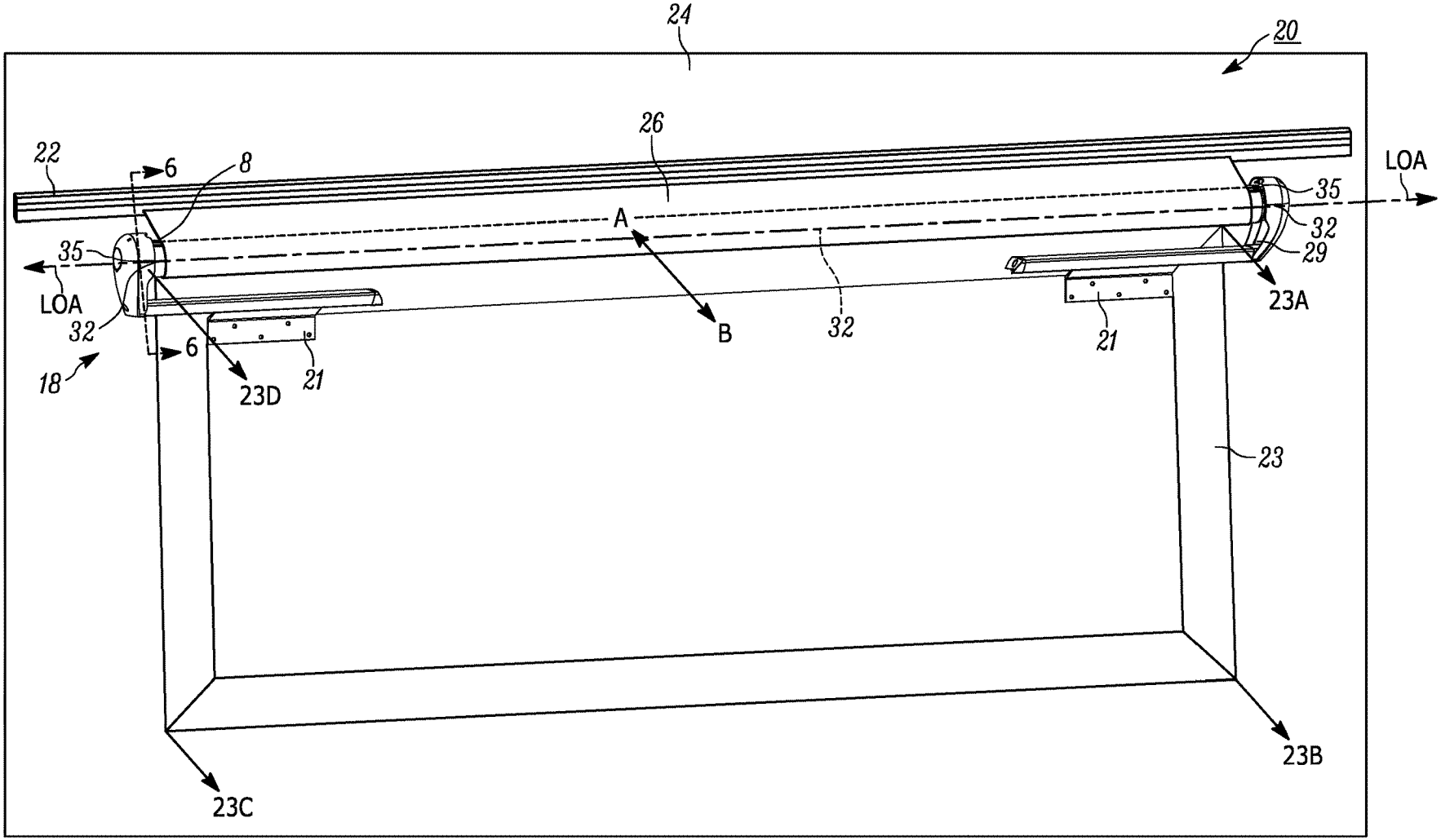
FIG. 5 is a perspective view of a anti-billowing awning canopy assembly in an retracted position supported by a recreation vehicle over a slide-out in accordance with another example embodiment of the present disclosure.

In another example embodiment, such as illustrated in FIG. 5, the roll bar 32 is driven by a slide-out structure 23, wherein the roller assembly 29 and the end caps 35 are connected to support flanges 21 attached to the slide-out structure 23. It is understood that the support flanges 21 may have multiple types of connection to the slide-out structure 23, such as horizontal support flanges 21, as illustrated, vertical support flanges, angle iron or aluminum extrusions, and the like. The slide-out structure 23 extends the awning canopy 26 by sliding out a portion of the support structure 24 comprising the slide-out structure 23. For example, the slide-out structure 23 may advance from the recreational vehicle as indicated by arrows 23A-23D to provide more room within the recreational vehicle. In an example embodiment, to open the awning assembly 20, the roll bar 32 is rotated in a second direction B, responsive to the slide-out 23 extending out away from the support structure 24, to extend the awning assembly by unwrapping the awning canopy 26 from the roll bar 32. Conversely, to close the awning assembly 20, the roll bar 32 is rotated in a first direction A, responsive to the slide-out structure 23 contracting toward and into the support structure 24, to contract the awning assembly 20 by wrapping the awning canopy 26 around the roll bar 32 driven by a mechanical spring/tensioner (not shown).

As will be appreciated, as the roll bar 32 is extended in one or the other direction, such as by the motor, motors, or by the slide-out structure 23 going out from or into the support structure 24, the awning canopy 26 is rolled onto or unrolled from the axle 75 of the roll bar 32, causing the awning assembly 20 to retract or extend, respectively.

The rolling assembly 29, as illustrated in FIG. 6, is operably connected to the awning canopy 26 via the hub 31 (as illustrated in FIG. 7 without the roll bar 32 for illustrative purposes) and the roll bar 32. The lock bearing 52, as illustrated in FIGS. 7-10, is not illustrated for clarity in FIG. 6. The rolling assembly 29 comprises a track assembly 58 comprising a first wheel 56A and a second wheel 56B operably connected to a track 54. In one example embodiment, the first wheel 56A and the second wheel 56B concomitantly move along a same axis (longitudinal axis (LOA) relative to the track 54. In another example embodiment, the track 54 is connected to at least one of the end cap 35, a connection fixture 41, or the support structure 24.

In the illustrated example embodiment, the track assembly 58 comprises a rotatable connection 59 with the hub 31. For example, the track assembly 58 will not rotate while the hub 31, the roll bar 32, the axle 75, and in some conditions, the lock bearings or sprockets 52 rotate to unspool or spool the awning canopy 26. In an example embodiment, the rotatable connection 59 comprises a shaft 59A rotating through the track assembly 58, the shaft 59A forming a hub axle 59B fixed to the hub 31, and the lock bearing 52, as illustrated in FIG. 7, rotating through the track assembly. In one example embodiment, the shaft 59A is a threaded fastener that is threaded into a tapped opening of the hub 31 for form the hub axle 59B.

In the illustrated example embodiment, the rolling assembly 29 is in contact or coupled to, via the roll bar 32 and/or the track assembly 58, with an alignment component 17 at a contact point 15 (see FIG. 6). The contact point 15 is maintained by a tension component 12 and gravity. The tension component 12 is operably connected to the rolling assembly 29, such as via the track assembly 58, and to the end cap 35. In an example embodiment, the tension component 12 biases the track assembly 58 to push the rolling assembly 29 in a first direction 13A toward the alignment component 17. The tension component 12 in one example embodiment, comprises a spring, such as a flat spring, a compression spring, a torsion spring, spring steel spacer, a tension spring, and the like The location of the spring or tension component 12 relative to the rolling assembly 29 and the alignment component 17 is variable based on the type of spring. The spring location may be selected to maintain the force on the rolling assembly 29 in the first direction 13A. For example, such as when the spring comprises the tension spring, the spring is located adjacent the alignment component 17.

Responsive to a second force, over a force threshold, being applied to the awning canopy 26 and/or the role bar 32, the rolling assembly 29 is moved in a second direction 13B, along the track 54 via the track assembly 58, away from the alignment component 17. In one example embodiment, the second force is applied in a same direction as the second direction 13B. In another example embodiment, the force threshold comprises a force sufficient to cause the awning canopy 26 to unspool. The force threshold may be selected for by altering the force that the tension component 12 applies. The second force is, for example, generated by gusts of wind, or, such as when the awning assembly 20 is attached to a mobile structure, wind generated based on road dynamics, weather, and/or a speed of the mobile structure.

In the illustrated example embodiment, the lock bearing 52 is coupled to the rolling assembly 29, as illustrated in FIGS. 7-10. In an example embodiment, the lock bearing 52 is between the track assembly 58 and the hub 31, as illustrated in FIG. 7. In another example embodiment, the track assembly 58 is between the lock bearing 52 and the hub 31, wherein the rotatable connection 59 is on a first side of the lock bearing 52 and the track assembly 58 and travels through the track assembly 58 to connect to the hub 31 on a second side of the lock bearing 52 and the track assembly 58, wherein the first side is opposite the second side. The hub 31 and the lock bearing 52 may then rotate together on either side of the track assembly 58.

The lock bearing 52 comprises a plurality of teeth 16 configured to interact with at least one of a plurality of locks 14 comprised on the end cap 35. In an example embodiment, a first lock 14A and/or a second lock 14B of the plurality of locks 14 comprises a protrusion extending out from the end cap 35. In an example embodiment, the protrusion protrudes at a substantially 90° angle from the end cap 15 toward the lock bearing 52.

Figure 8:
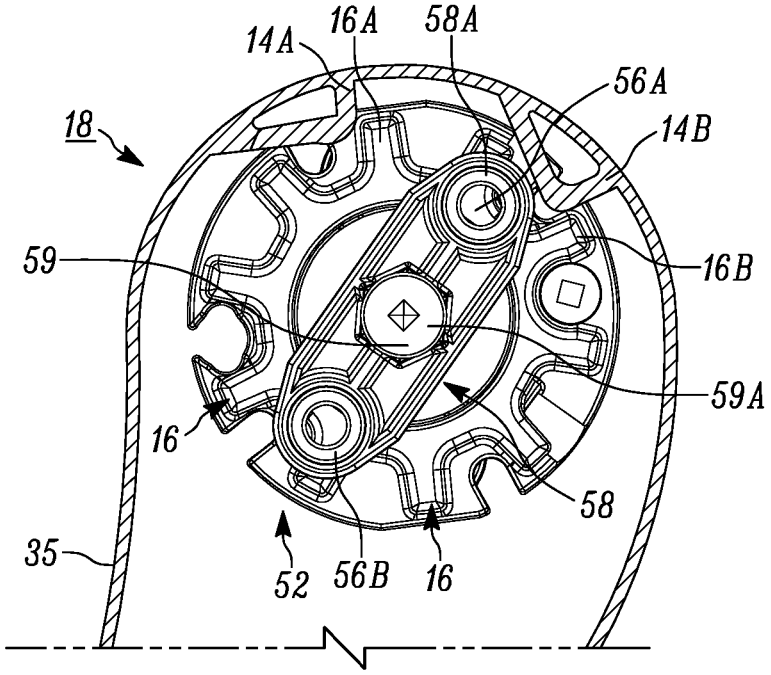
FIG. 8 is a magnified side elevation of a lock bearing and an end cap illustrated in the assembly view of FIG. 7 constructed in accordance with one example embodiment of the present disclosure.

Responsive to the second force, over the force threshold, being applied to the awning canopy 26 and/or the role bar 32, the rolling assembly 29 is moved in the second direction 13B, along the track 54 via the track assembly 58, such that at least one of the plurality of teeth 16 interlocks with at least one of the plurality of locks 14. The interlocking of at least one of the plurality of teeth 16 with at least one of the plurality of locks 14 comprises a locked mode of the rolling assembly 29, such as illustrated in FIG. 8. The locked mode disallows rotation of the hub 31, and thus the role bar 32, by preventing rotation of the lock bearing 52 coupled to the rolling assembly 29.

Figure 9:
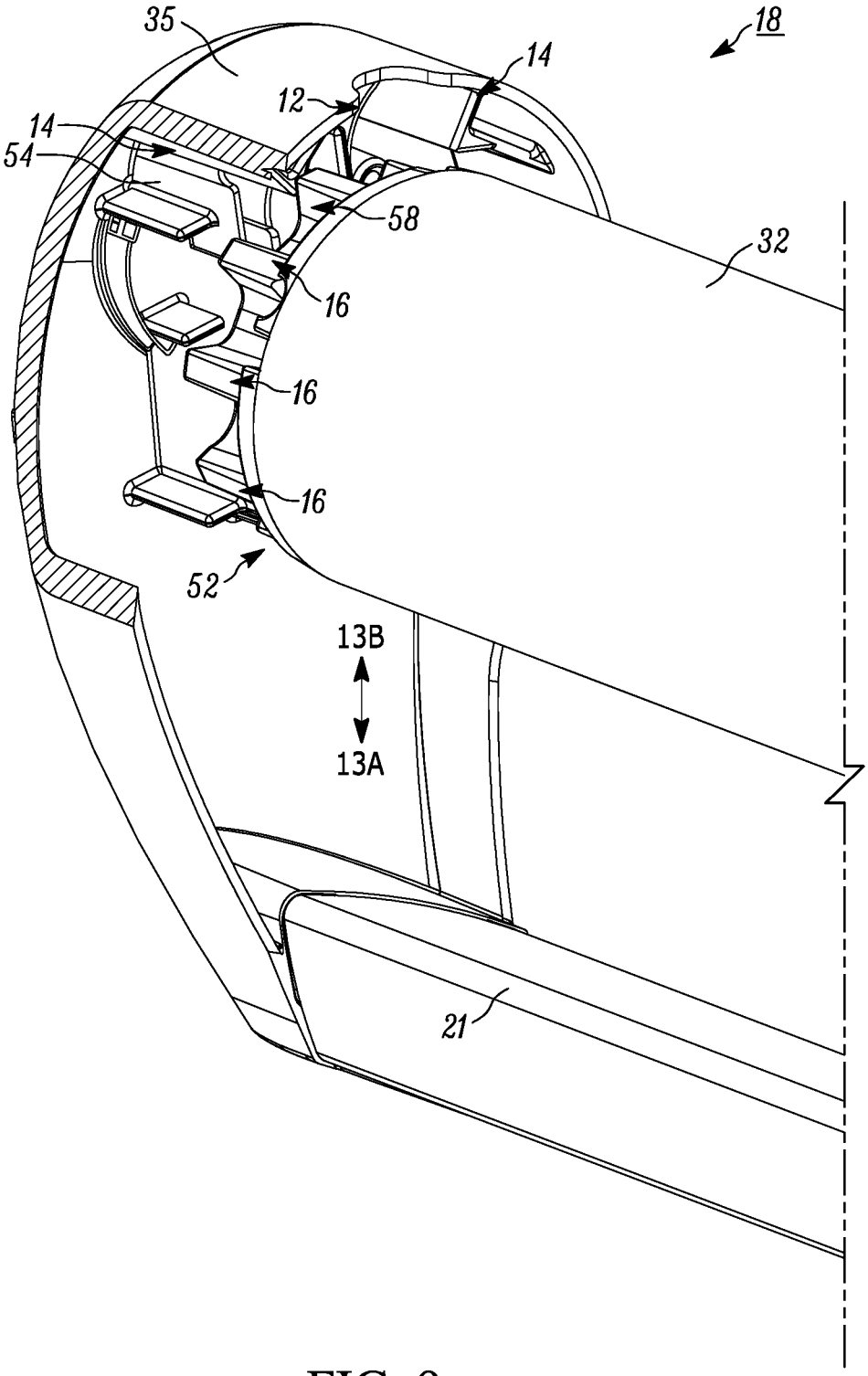
FIG. 9 is a magnified-prospective view of one-end of a anti-billowing awning assembly constructed in accordance with another example embodiment of the present disclosure.
Figure 10:
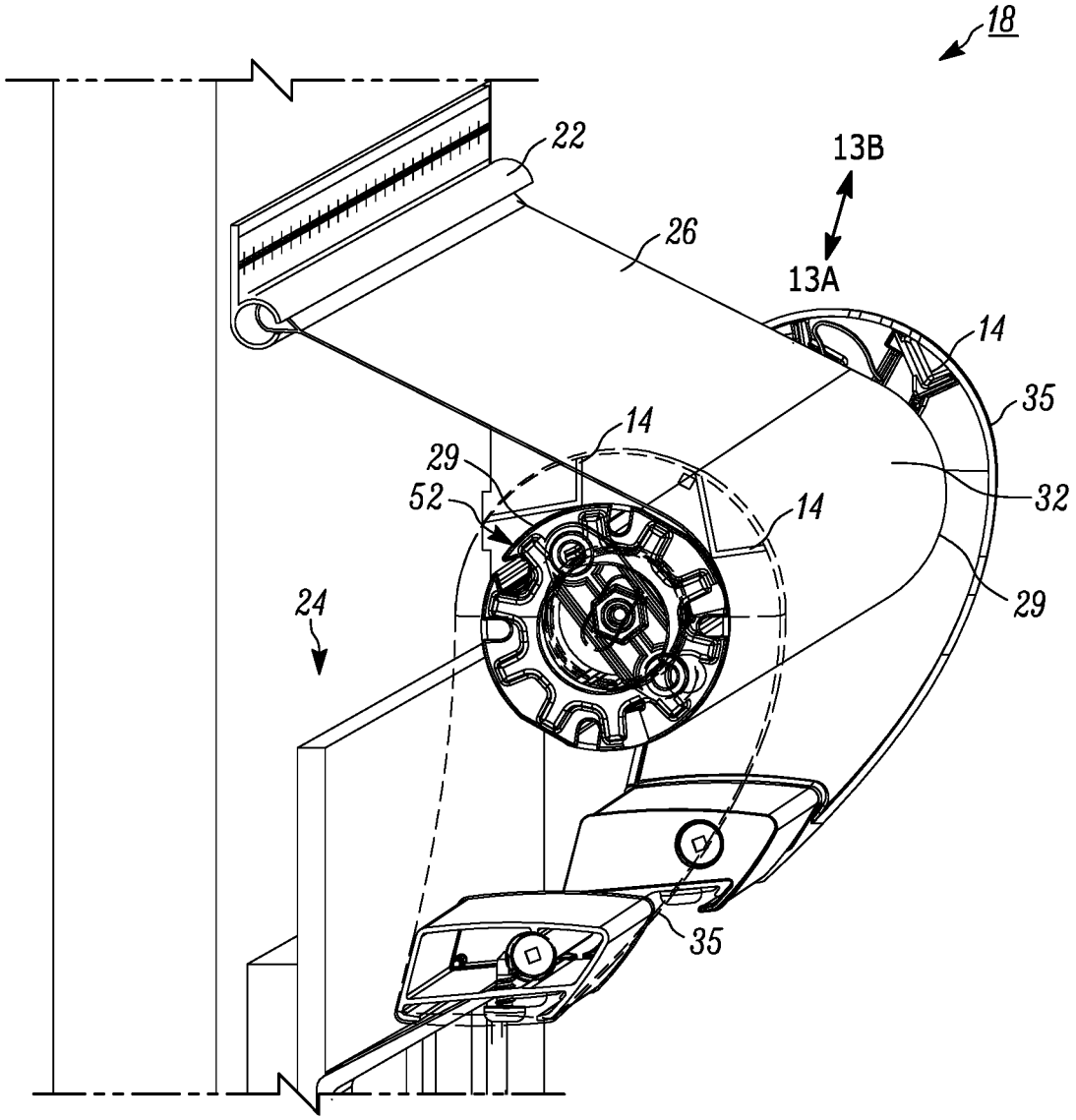
FIG. 10 is a perspective view of an anti-billowing awning assembly in a partially open view constructed in accordance with another example embodiment of the present disclosure.

The plurality of teeth 16 and the plurality of locks 14 are configured to be free from interaction when the tension component 12 is maintaining the rolling assembly 29 in an unlocked mode, as illustrated in FIGS. 7, 9-10. Absent the second force, the tension component 12 and gravity maintain the contact 15 between the rolling assembly 29 and the alignment component 17. In the illustrated example embodiment, the rolling assembly 29 is maintained in the unlocked mode when the lock bearing 52 is free from contact with the plurality of locks 14. In the unlocked mode, the plurality of teeth 16 cannot come into contact with any of the plurality of locks 14. Thus, in the unlocked mode, rotation of the hub 31 and roll bar 32 are not prevented by the lock bearing 52 interacting with the plurality of locks 14.

The rolling assembly 29 and the lock bearing 52 are present in one of a first end cap 35A, a second end cap 35B, or both. For example, the first end cap 35A houses the rolling assembly 29 and the lock bearing 52, and the second end cap 35B houses a standard hub 31, connected to the roll bar 32. The standard hub 31 merely rotates to spool or unspool the awning canopy 26. In another example embodiment, as illustrated in FIG. 7, the first end cap 35A houses a first rolling assembly 29A and a first lock bearing 52A, and comprise the first lock 14A and the second lock 14B, and the second end cap 35B houses a second rolling assembly 29B and a second lock bearing 52B, and comprise a third lock 14C and a fourth lock 14D.

In an example embodiment of the locked mode, as illustrated in FIG. 8, a first tooth 16A of the plurality of teeth 16 interlocks with the first lock 14A of the plurality of locks 14 and a second tooth 16B of the plurality of teeth 16 interlocks with the second lock 14B, of the plurality of locks 14. The interlocking of the first and second teeth 16A-16B to the first and second locks 14A-14B, respectively, is maintained so long as the second force is maintained. Responsive to the second force dropping below the force threshold, the rolling assembly 29 will return to the unlocked mode. The ability to switch from the unlocked mode to the locked mode responsive to an applied force, prevents unwanted unspooling of the awning assembly 20, especially while coupled to a moving vehicle.

During operation, the biasing member 12 biases the rolling assembly 29 to an unlocked condition, and thus, the hub 31, track assembly 58, the axle 59, roller bar 32, lock bearing or sprocket 52, and canopy 26 can rotate in either a first direction or second direction. In this unlocked condition, the hub 31, track assembly 58, the axle 59, roller bar 32, lock bearing or sprocket 52, and canopy 26 can unwind or unspool from the roller bar or be wound or spooled back onto the roller bar 32, either manually or assisted by the motor located within the end caps 35 or on the awning assembly 20.

Under certain operating conditions, forces overcome the biasing member 12, allowing the track wheel assembly 58 of the rolling assembly 29 to translate smoothly to a locked position, and thus, the hub 31, track assembly 58, the axle 59, roller bar 32, lock bearing or sprocket 52, and canopy 26 to a locked position where the canopy cannot unwind or unspool from the roller bar along one of a clockwise or counterclockwise direction. In the locked position, the teeth 16 prevent rotation of the sprocket 52 because they engage a lock 14. In one example embodiment, the lock 14 is includes a ramp in one direction and an abutment in another direction, and the lock and teeth of the sprocket are coplanar. As such, rotation of the sprocket 52 in a first direction causes the teeth to engage the abutment face of the lock, thus preventing rotation of the sprocket 52. While rotation of the sprocket 52 in a second direction, opposite the first direction, the teeth 16 engage the lock 14 ramp, allowing rotation of the sprocket in a the second direction.

In the illustrated example embodiment, the rolling assembly 29 comprising the hub 31, track assembly 58, the axle 59, roller bar 32, lock bearing or sprocket 52, and canopy 26 are all interconnected such at rotation of one member results in the rotation of all other members. Further, the track assembly 58 comprise first and second wheels 56A and 56B, respectively that allow the translation of the roller assembly between a locked and unlocked position via tracks 54 spaced about the wheels in which the track assembly translates by the biasing member 12 or when forces overcome the biasing member.

When the rolling assembly 29 is in the locked position, wind dynamics, bumps, and road conditions advantageously no longer permit the awning canopy 26 from billow or unspool suddenly. Unspooling or billowing during driving may create a hazardous condition prevented by the anti-billow awning assembly 20 as described above. Wind or bumpy road conditions will now drive the roller assembly 29 into the locked condition stopping the unspooling of the awning by the locks preventing rotation in the unspooling direction. When the wind event or bumpy conditions cease, the roller assembly 29 is assisted by gravity and/or the biasing member 12 into a normal operating condition. The current design of the anti-billowing awning further advantageously no longer requires any interface with the wall of the recreational vehicle, eliminates any reliance on proper installation, unlike conventional awnings that require installers to properly adjust bolts to have the correct extension, and the anti-bellow design provides a clean appearance with no external components.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A method of providing an awning canopy assembly, the method comprising:

providing an awning connection system that couples an awning canopy to a support structure during use, the providing the awning connection system comprising:

operably connecting a rolling assembly to the awning canopy;

coupling a lock bearing to the rolling assembly; and coupling an end cap to the rolling assembly, said end cap comprising at least one lock, the rolling assembly comprises an unlocked mode, wherein the lock bearing is free from contact with the at least one lock, and a locked mode, wherein the lock bearing is in contact with the at least one lock, responsive to an application of a force over a force threshold in a first direction to the rolling assembly via the awning canopy, the rolling assembly comprises the locked mode.

2. The method of claim 1, wherein the rolling assembly is operably connectable to a roll bar during use, and wherein during use, responsive to an application of a force over a force threshold in the first direction to the roll bar, the rolling assembly comprises the locked mode.

3. The method of claim 1, wherein coupling the end cap to the rolling assembly comprises coupling the end cap to the rolling assembly via a track wheel assembly having first and second wheels for movement of the rolling assembly and the lock bearing along a track between the locked position and the unlocked position.

4. The method of claim 3, further wherein coupling the end cap to the rolling assembly via the track wheel assembly comprises retaining the first and second wheels in the track, which comprises a linear track wherein the first and second wheels travel in a first direction into the locked position and a second direction into the unlocked position, wherein the lock bearing is freely rotatable while in said unlocked position, further wherein the first direction is opposite the second direction along the track.

5. The method of claim 1, wherein coupling the end cap to the rolling assembly comprises coupling the end cap having a plurality of locking teeth to the rolling assembly, wherein the plurality of locking teeth interact with the lock bearing coupled to the rolling assembly when in the locked position, wherein at least one locking tooth of the plurality of locking teeth interlocks with said at least one lock of the lock bearing preventing rotation of the rolling assembly in at least one direction to prevent unspooling of said awning canopy.

6. The method of claim 1, wherein operably connecting the rolling assembly to the awning canopy comprises connecting the awning canopy such that the awning canopy extends along a longitudinal axis, further comprising connecting the rolling assembly such that it moves along a linear path between the locked and unlocked positions, the linear path transverse to the longitudinal axis.

7. The method of claim 1, wherein operably connecting the rolling assembly to the awning canopy comprises connecting the awning canopy such that the awning canopy extends along a longitudinal axis, further comprising connecting the rolling assembly such that it moves along a linear path between the locked and unlocked positions, the linear path perpendicular to the longitudinal axis.

8. The method of claim 1, wherein operably connecting the rolling assembly to the awning canopy comprises attaching the rolling assembly operably to a hub of a roll bar via a rotatable connection and wherein, the rotatable connection is coupled to and between two wheels, the two wheels movably retained within a linear track, wherein the rotatable connection and the two wheels are located along a common axis.

9. The method of claim 1, further comprising coupling a tension component to the rolling assembly, wherein the tension component maintains the rolling assembly in the unlocked mode absent a force in a first direction, wherein the tension component applies force in a second direction, the second direction opposite the first direction.

10. The method of claim 1, wherein operably connecting the rolling assembly to the awning canopy comprises coupling the rolling assembly to the awning assembly such that a track of the rolling assembly is oriented at least one of transverse or perpendicular to the awning canopy.

11. A method of providing an awning canopy assembly, the method comprising:

providing an awning connection system that couples an awning canopy to a support structure during use, the providing the awning connection system comprising:

operably connecting a rolling assembly to the awning canopy via a rotatable hub that supports the awning canopy and a track movably retaining first and second wheels that allow movement of the awning canopy and rotatable hub between an unlocked position and a locked position responsive to a force over a force threshold being applied to the rolling assembly via the awning canopy;

coupling a lock bearing to the rolling assembly; and coupling an end cap to the rolling assembly, said end cap comprising at least one lock that interacts with the lock bearing when in the locked position.

12. The method of claim 11, comprising coupling the end cap to the rolling assembly such that the lock bearing is free from contact with the at least one lock in the unlocked mode, and the lock bearing is in contact with the at least one lock in the locked mode.

13. The method of claim 11, wherein operably connecting the rolling assembly to the awning canopy further comprises coupling the rotatable hub to and between two wheels movably retained within the track.

14. The method of claim 11, wherein operably connecting the rolling assembly to the awning canopy further comprises coupling the rotatable hub to and between two wheels retained within the track such that the rotatable hub and the first and second wheels exist along a common axis.

15. The method of claim 11, wherein operably connecting the rolling assembly to the awning canopy comprises connecting the awning canopy such that the awning canopy extends along a longitudinal axis, further comprising connecting the rolling assembly to the awning canopy such that the rolling assembly and the awning canopy moves along a linear path, the linear path transverse to the longitudinal axis.

16. The method of claim 11, further comprising coupling a tension component to the rolling assembly, wherein the tension component maintains the rolling assembly in contact with a track stop, the track stop comprising a contact point between the track assembly and the end cap, wherein when the rolling assembly is in contact with the track stop the awning assembly is in the unlocked mode.

17. The method of claim 11, further comprising coupling a tension component to the rolling assembly, wherein the tension component retains the rolling assembly in the unlocked position absent a force in a first direction, wherein the tension component applies force in a second direction, the second direction opposite the first direction.

18. The method of claim 11, wherein operably connecting the rolling assembly to the awning canopy comprises connecting the rolling assembly such that the track of the rolling assembly is oriented at least one of transverse or perpendicular to the awning canopy.

19. The method of claim 11, wherein operably connecting the rolling assembly to the awning canopy further comprises coupling the rotatable hub to and between two wheels movably retained within the track, wherein the first and second wheels are co-axial to each other and the track is linear.

20. A method of providing an awning canopy assembly, the method comprising:

providing an awning connection system that couples an awning canopy to a support structure during use, the providing the awning connection system comprising:

operably connecting a rolling assembly to the awning canopy via a rotatable hub that supports the awning canopy and a track movably retaining first and second wheels that allow movement of the awning canopy and rotatable hub between an unlocked position and a locked position responsive to a force over a force threshold applied to the rolling assembly via the awning canopy or applied directly to the awning canopy;

coupling an end cap to the rolling assembly, said end cap comprising at least one lock that interacts with a lock bearing when in a locked position;

coupling a tension component to the rolling assembly, wherein the tension component maintains the rolling assembly in contact with a track stop, the track stop comprising a contact point between the track assembly and the end cap, wherein when the rolling assembly is in contact with the track stop the awning assembly is in the unlocked mode; and coupling the rotatable hub to and between two wheels retained within the track such that the rotatable hub and the first and second wheels share a common axis.

* * * * *